United States Patent [19]

Watts

[11] 4,025,119

[45] May 24, 1977

[54] METHOD AND APPARATUS FOR STRIP MINING

[76] Inventor: James P. Watts, 6930 E. Pinchot Ave., Scottsdale, Ariz. 85251

[22] Filed: Dec. 1, 1975

[21] Appl. No.: 636,407

[52] U.S. Cl. ..... 299/18; 37/142.5; 175/88; 175/91; 175/173; 299/7

[51] Int. Cl.[2] ..... E21C 41/00

[58] Field of Search ..... 299/7, 18, 56; 175/88, 175/91, 172, 173; 198/66, 68, 71; 37/142.5

[56] References Cited

UNITED STATES PATENTS

| | | | |
|---|---|---|---|
| 536,340 | 3/1895 | Hanneborg | 37/142.5 X |
| 796,477 | 8/1905 | Wallace | 198/68 |
| 1,814,093 | 7/1931 | Rhodes | 175/88 |
| 2,561,343 | 7/1951 | Crossley | 175/91 |
| 3,951,459 | 4/1976 | Honeycutt | 299/18 X |

*Primary Examiner*—Ernest R. Purser
*Attorney, Agent, or Firm*—John A. Robertson

[57] ABSTRACT

A method of strip mining in which a plurality of vertical shafts of square cross section are formed closely adjacent to one another with each shaft extending through overburden and a layer of valuable material such as coal. As spoil is removed in forming one shaft it is conveyed to a previously formed shaft and deposited therein. The apparatus includes a casing of square cross section, a cylindrical auger casing within the square casing, an auger rotatable in the auger casing and a square cutter at the lower end of the square casing. The latter is slidably mounted on a vertical track and is power driven vertically to force the cutter into the earth formation being worked. The auger is rotated under power to cut into the earth formation and remove spoil and coal therefrom. The upper end portions of both casings are formed with two sets of aligned discharge ports. A movable closure is provided for each set and a rake for each set. A conveyer for spoil has one end connected to the outer port of one set while a conveyer for coal has one end connected to the outer port of the other set. When one set is closed, the rake associated therewith is in an inoperative position. When a set of ports is open, the rake associated therewith extends into the uppermost convolution of the auger.

13 Claims, 6 Drawing Figures

METHOD AND APPARATUS FOR STRIP MINING

The present invention has to do with strip mining and is concerned primarily with a method and apparatus which satisfies today's environmental requirements and at the same time provides for the efficient removal of a layer of valuable material such as coal which occurs naturally beneath overburden.

BACKGROUND OF THE INVENTION

At the present time, conventional methods employed in strip mining are under attack by environmentalists because of the condition in which terrain is left after coal has been removed therefrom. These conventional methods may be generally characterized as including as a first step the removal of the overburden by excavators and/or explosives. The layer of valuable material which ordinarily is coal is then removed by a comparable step.

It is evident that the spoil created by removing the overburden must be conveyed away an appreciable distance to allow room for the coal removing apparatus to function. Moreover, if the environmental standards are to be satisfied, the spoil must then be returned to a mining area. This handling of the spoil is at best highly inefficient and expensive.

OBJECTS OF THE INVENTION

With the foregoing conditions in mind, the present invention has in view the following objectives:

1. To provide a strip mining method which is characterized by the formation of a plurality of shafts of square horizontal cross section which are arranged closely adjacent to one another with each shaft extending through the overburden and the layer of coal.

2. To provide, in a strip mining method of the type noted, the step of conveying the spoil which is removed from the overburden to a previously formed shaft and depositing it therein.

3. To provide, in a strip mining method of the character aforesaid, the step of conveying coal removed from the layer as the shaft is formed to a storage receptacle.

4. To provide a strip mining method, of the kind described, which is carried out by apparatus which includes as a characteristic and essential element an auger assembly which forms a shaft of square horizontal cross section.

5. To provide a strip mining apparatus, of the type noted, which includes two conveyers each of which has one end connected to the auger assembly with one conveyor receiving spoil and the other receiving coal.

6. To provide, in strip mining apparatus of the character aforesaid, mechanism for rendering one of said conveyers effective to the exclusion of the other.

Various other more detailed objects and advantages of the invention, such as arise in connection with carrying out the above ideas in a practical embodiment will, in part, become apparent and, in part, be hereinafter stated as the description of the invention proceeds.

SUMMARY OF THE INVENTION

The foregoing objects are achieved by providing a vehicle having traction elements suitable for travel over an area to be mined. A vertical guide or track is supported in an upright position at the front of the vehicle. A lower guide is supported from the ground and is connected to the front of the vehicle in a position in which it aligns with the upraised guide.

A square casing defined by four walls passes through the lower guide with one wall being operably connected to the upraised guide. Each wall of this casing is formed with a vertical rack. Meshing with each rack is a pinion that is driven by a hydraulic motor mounted on the lower guide.

Disposed within the square casing and connected to the four walls thereof is a cylindrical auger casing. Rotatably mounted within the auger casing and held against longitudinal movement relative thereto is an auger. The main body portion of the auger is snugly received within the bore of the auger casing but the lower convolutions of the auger located beyond the lowermost end of the two casings are of enlarged diameter. The lower end of the square casing is provided with a cutter preferably in the form of cutting edges integral therewith.

Extending across the upper ends of both casings is a horizontal wall in which the upper end of the auger shaft is jounalled. Driveably mounted to the auger shaft is a large gear which is rotated by a plurality of hydraulic motors mounted on this horizontal wall. Immediately below this horizontal wall and in the areas where the auger casing is secured to the square casing two sets of aligned discharge ports are formed. One set being formed in one side wall of the square casing and the other in another side wall. Mounted on the side walls of the square casing are two discharge chutes each communicating with a discharge port. A sliding closure is associated with each discharge port where the chute is connected thereto. Each closure is operated by a hydraulic cylinder and piston assembly. A rake is associated with each set of aligned openings and when in effective position extends into the upper convolution of the auger to remove material therefrom as the auger rotates and pass it to a discharge chute. A hydraulic motor is provided for each rake to move it into and out of effective position. When a discharge port is closed the rake associated therewith is inoperable.

A conveyor has one end pivotally mounted to the outer end of a discharge chute; there being a conveyer for each discharge chute. One of these conveyers is for spoil and the other for coal.

In briefly outlining the subject method it will be assumed that at least one vertical shaft has been formed or there is a place of disposal for the spoil from the first shaft. With the auger assembly comprising the square casing, the auger casing therewithin, and the auger in position over a location where a shaft is to be formed, the auger is rotated under power derived from the hydraulic motors and the entire auger assembly is urged downwardly into the earth formation by the rack and pinion mechanism which are driven by the hydraulic motors on the lower guide. The auger forms a cylindrical hole which is transformed into a hole of substantially square cross section by the cutter on the lower end of the square casing. As material is cut, it is moved upwardly by the auger.

Inasmuch as the overburden will be the layer which is first subject to the auger, the discharge port for coal will be closed and the rake associated therewith will be retracted. The discharge port for the spoil is open and the rake associated therewith in effective position. Thus, spoil is removed from the upper convolution of the auger, passed through the discharge port into the discharge chute and thence onto the conveyor which transfers it to a previously formed shaft into which it is deposited.

After the overburden has been cut through, the discharge port for the spoil is closed and that for the coal is opened. The rake for the spoil is retracted and the rake for the coal swung into effective position. The coal is now passed through the open discharge chute onto the conveyor for coal which transfers it to a desired storage receptacle.

For a full and more complete understanding of the invention, reference may be had to the following description and accompanying drawings wherein.

Figure 2:
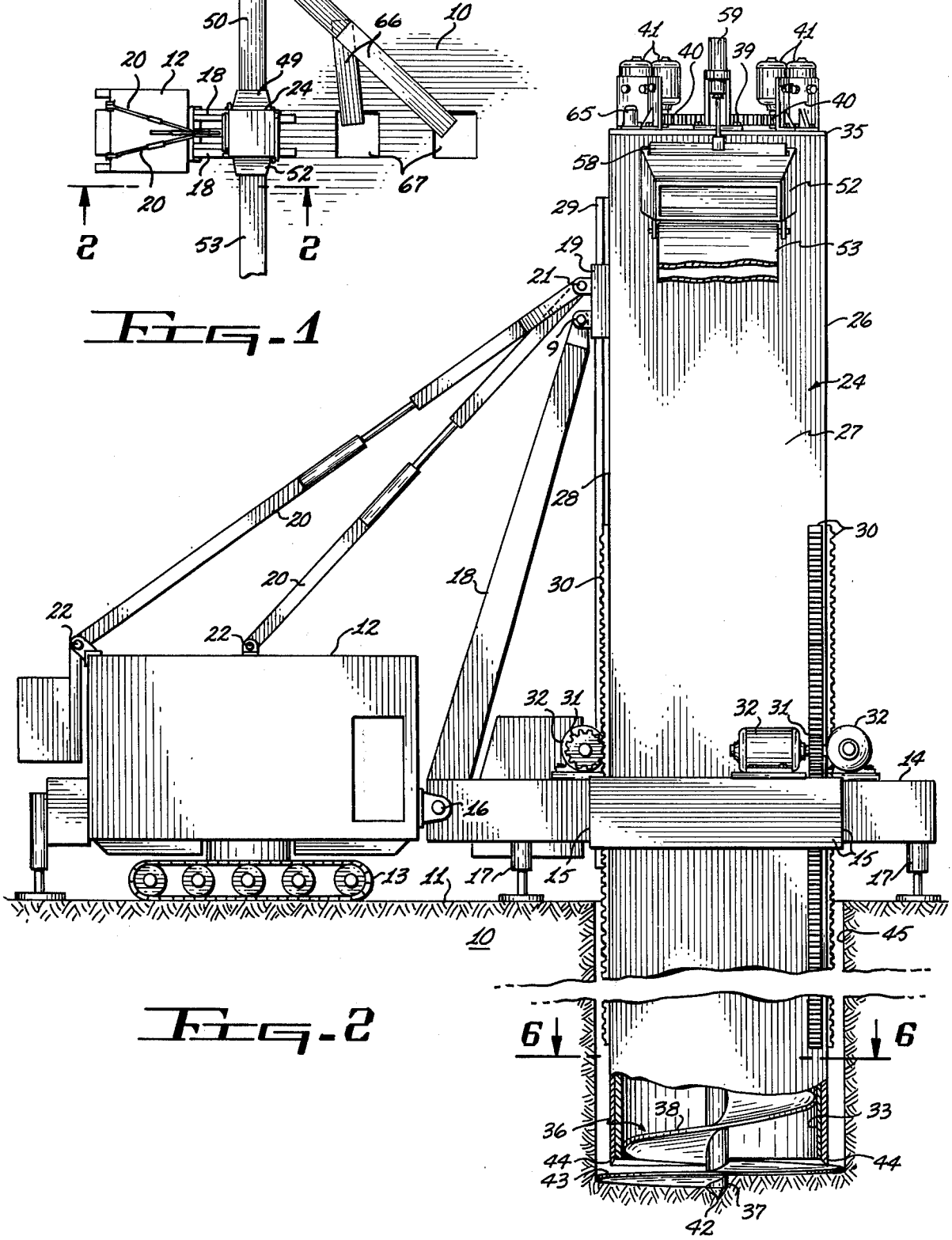
FIG. 2 is a side view taken as a section through an earth formation illustrating the apparatus of this invention with a portion of the square casing broken away.

Referring now to the drawings wherein like reference characters denote corresponding elements throughout the several views, and first more particularly to FIG. 2, a ground formation is shown at 10 as including an upper surface 11. It will be understood that the ground formation 10 includes an upper layer commonly referred to as overburden and the overburden after being removed is commonly designated spoil. A vehicle 12 has traction elements 13 designed to travel over ground surface 11. Extending forwardly of vehicle 12 and in a substantially horizontal position is a lower guide 14. Guide 14 includes four walls 15 which define a square opening. Guide 14 is pivotally connected to vehicle 12 at 16 and is supported from ground surface 11 by jack 17. Extending upwardly from pivotal connection 16 are a pair of booms 18 to which an upraised guide 19 is pivotally connected as indicated at 9. Guide 19 is given additional support by a pair of guy rods 20 which are pivotally connected to guide 19 at their upper ends as indicated at 21. The lower ends are pivotally connected to vehicle 12 at 22.

Figure 3:
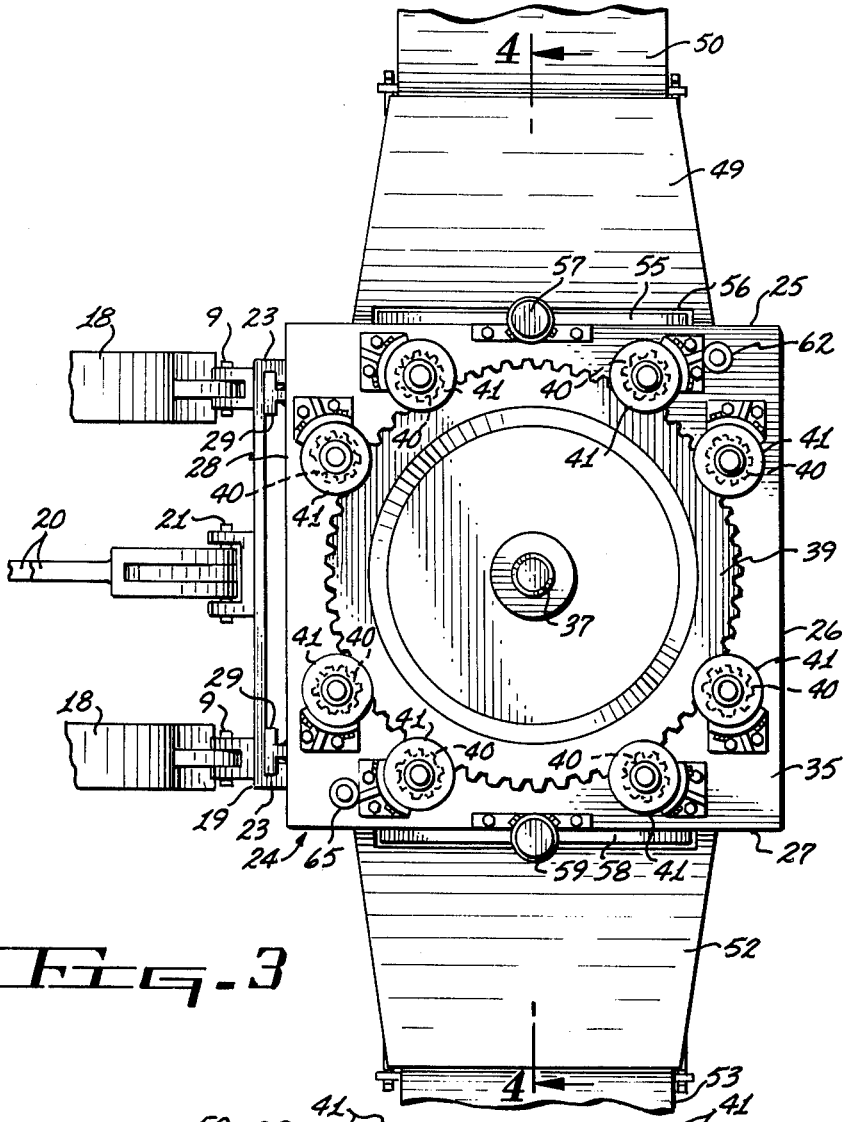
FIG. 3 is a top plan view taken on an enlarged scale of the auger assembly and mechanism immediately associated therewith.
Figure 5:
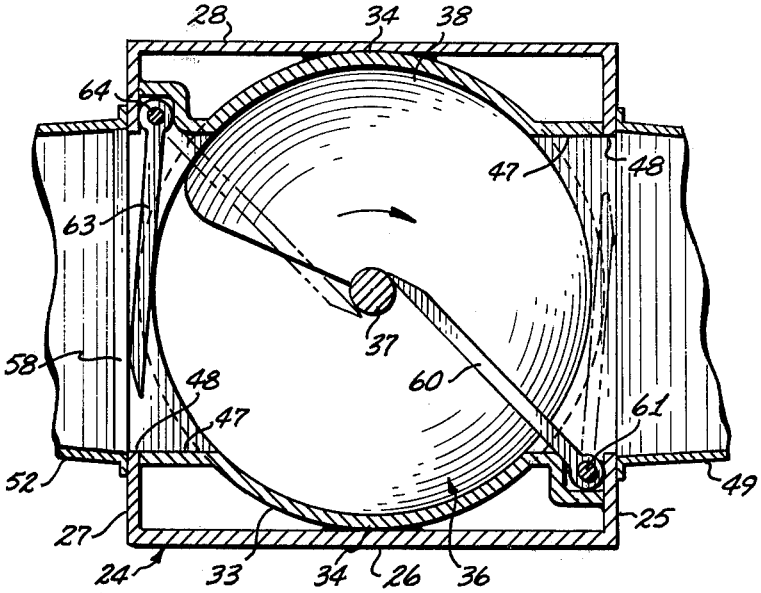
FIG. 5 is a horizontal section taken on the plane of the line 5—5 of FIG. 4.
Figure 6:
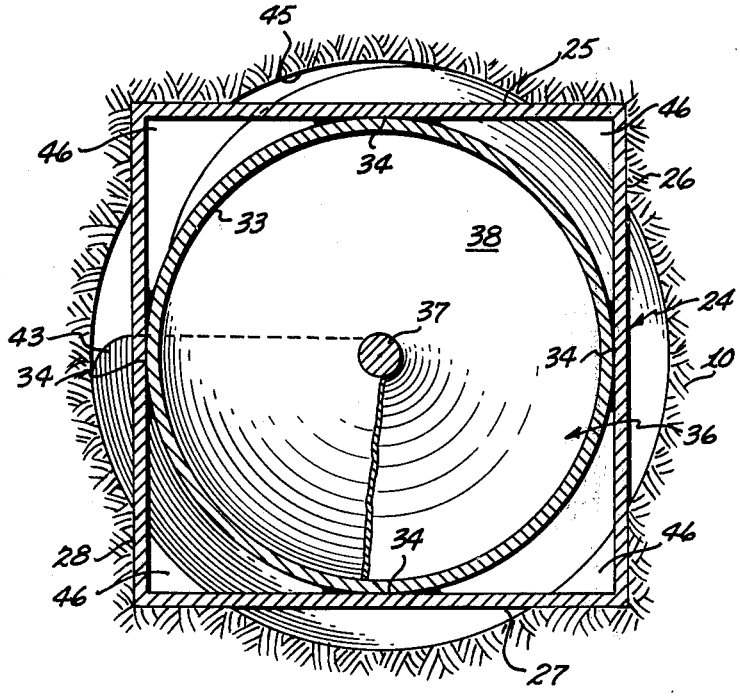
FIG. 6 is a horizontal cross section taken on the plane of the line 6—6 of FIG. 1.

Referring for the moment and more particularly to FIG. 3, it will be noted that guide 19 is formed with a channel 23 at each of its vertical side edges. A square casing is identified in its entirety by the reference character 24. As shown in FIGS. 5 and 6, it comprises four side walls 25, 26, 27, and 28. Referring now back to FIG. 3, a pair of guide rails 29 each of which is of T cross section are received in channels 23. Thus, casing 24 is guided in its vertical movement by guide 19 and rails 29.

Referring now to FIG. 2, square casing 24 is shown as passing through the square opening defined by the four walls 15 of lower guide 14. Wall 27 is formed with a rack 30 along one side edge. Meshing with rack 30 is a pinion 31 which is driven by a hydraulic motor 32. There is a rack 30, pinion 31, and hydraulic motor 32 for each of the walls 25, 26, and 27. It is evident that as the motors 32 are operated casing 24 is moved vertically.

As shown more clearly in FIGS. 5 and 6, an auger casing 33 is assembled within square casing 24 being secured to the side walls thereof where the casing engages them in any preferred manner as by welding as indicated at 34. Mounted on the upper top edges of each of the walls of casing 24 and auger casing 23 is a horizontal plate 35 which is shown more clearly in FIGS. 4 and 5. An auger is referred to generally at 36 and comprises an auger shaft 37 and a helical blade 38. The upper end of shaft 37 is journalled in an opening formed in plate 35 and driveably mounted on the upper portion of shaft 37 is a gear 39. Meshing with gear 39 are a plurality of pinions 40 with each pinion being driven by a hydraulic motor 41.

Auger shaft 37 is pointed at its lower end where it engages the ground as indicated at 42 and the lower convolution of blades 38 is of increased diameter as indicated at 43. A cutter may be added to the lower end of casing 24 but preferably takes the form of cutting edges 44. The lower convolutions 43 form a bore 45 of increased diameter as compared to the convolutions in the main body portion of augeer 36 and cutting edges 44 cut into the earth formation beyond bore 45 to form corner notches 46 as illustrated in FIG. 6. Thus, the hole which is formed by auger 36 and square casing 24 is substantially square in horizontal cross section.

Figure 4:
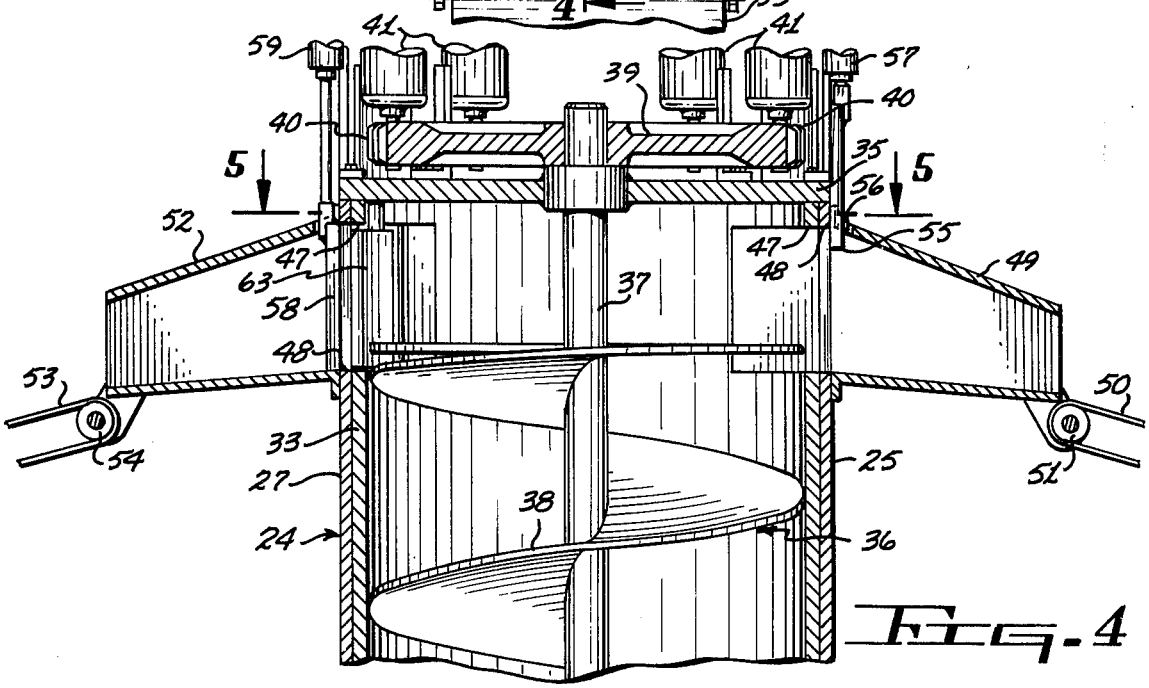
FIG. 4 is a detailed section taken on an enlarged scale and on the plane of the line 4—4 of FIG. 3.

Referring now more particularly to FIG. 4, where auger casing 33 meets walls 25 and 27 of casing 24, they are formed with a set of aligned discharge ports 47 and 48. There being two sets of such aligned ports. A discharge chute 49 is anchored to casing wall 25 at port 48 and extends laterally therefrom. A conveyer 50 for spoil has one end connected to the free end of chute 49. A pivotal connection is achieved by the fact that conveyor 40 is an endless belt and passes over roller 51 mounted on the end of chute 49.

Another discharge chute 52 is mounted on wall 27 at discharge port 48 and a conveyer 53 is pivotally connected thereto by passing over a roller 54 on discharge chute 52. For the purposes of this specification, it will be assumed that conveyer 50 is for spoil and conveyer 53 is for coal.

A closure in the form of a sliding door 55 is mounted on wall 25 and plate 35 and passes through a slot 56 formed in chute 49. It is opened by a hydraulic cylinder and piston assembly 57. Another sliding closure 58 is associated with chute 52 in the same manner and is operated by a hydraulic cylinder and piston assembly 59.

Referring now more particularly to FIG. 5, a rake 60 is shown as pivotally mounted at 61 and is imparted movement by a hydraulic motor 62 (FIG. 3). It extends over the uppermost convolution of auger blade 58 and when in the position illustrated in FIG. 5, passes spoil into discharge chute 49. Another rake 63 is pivotally mounted at 64 and is operated by hydraulic motor 65. It assumes the retracted position illustrated in FIG. 5 when chute 52 is closed but may be swung into the broken line position when this chute is open and chute 49 closed. In this broken line position, it delivers coal to the chute 52.

OPERATION OF THE PREFERRED EMBODIMENT

Figure 1:
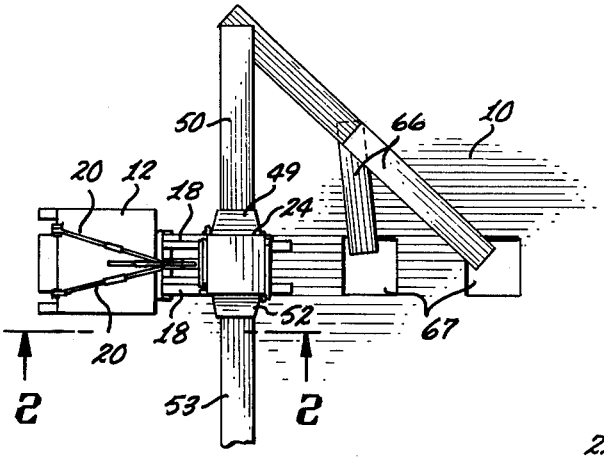
FIG. 1 is a top plan view highly diagrammatic depicting the conveyers for coal and spoil.

While the manner in which the subject strip mining method and apparatus operates is believed to be obvious from the illustration of the drawings and description of parts set forth above, it is briefly outlined as follows:

With auger 36 rotating and motors 32 in operation, the auger assembly comprising square casing 24, auger casing 33, and auger 36, digs into the ground to form a shaft which is substantially square in horizontal cross section. During the initial stage of this operation overburden will be cut and the spoil therefrom moved upwardly by auger blade 38. During this phase of the operation chute 49 is open and rake 60 is effective position while chute 52 is closed and rake 63 in retracted position. Thus spoil is passed from the auger, through discharge port 47–48 in the walls of the two casings and into discharge chute 49. From the latter it passes onto conveyor 50 which is connected to distribution conveyers 66 depicted in FIG. 1 which delivers the spoil to previously formed shaft 67.

When the lower end of auger assembly reaches the coal, chute 49 is closed and rake 60 retracted into the broken line position of FIG. 5, while chute 52 is opened and rake 63 moved into effective position. The coal is then removed from the auger blade 38, passed through the discharge port 47–48 into chute 52 and thence onto conveyor 53 which transfers it to a suitable storage receptacle which may be a truck, railroad car, or any other appropriate reception device.

When the auger assembly reaches the bottom of the coal formation, it is retracted by reversing the operation of the hydraulic motors 32 and after the lower end clears the ground surface 11, jacks 17 are retracted and vehicle 10 moved to a new location where another shaft is to be formed.

While a preferred specific embodiment of the invention is herein disclosed, it is to be clearly understood that the invention is not limited to the exact constructions, mechanism, and devices illustrated and described because various modifications of these details may be provided in putting the invention into practice.

What is claimed is:

1. In strip mining of a layer of valuable material covered by a layer of overburden, a method comprising the steps of:

a. successively forming a plurality of shafts of substantially square horizontal cross section with each shaft merging in with adjacent shafts whereby a designated area is completely mined, b. each of said shafts being formed by a vertically movable auger assembly including an auger casing, an auger rotatable in and held against longitudinal movement relative to the auger casing, and a square cutter at the lower end of said auger casing, c. removing spoil from the overburden through a first discharge port at the upper end of said auger casing as the auger cuts through said overburden, d. conveying said spoil to a previously formed shaft and depositing the spoil therein, e. removing valuable material through a second discharge port at the upper end of said auger casing as the auger cuts through said layer of valuable material, and f. conveying said removed valuable material to a storage receptacle.

2. The method of claim 1 together with the step of closing one of said discharge ports while the other is open.

3. The method of claim 1 together with the step of raking overburden spoil from the uppermost convolution of the auger when said first discharge port is open.

4. The method of claim 2 together with the step of raking valuable material from the uppermost level of said auger when said second discharge port is open.

5. The method of claim 1 together with the steps of guiding said auger assembly at two levels as the auger assembly is moved vertically and moving said auger assembly vertically under power.

6. The method of claim 1 in which the valuable material is coal.

7. The method of claim 6 in which the power for moving the auger assembly vertically takes the form of a plurality of hydraulic motors.

8. The method of claim 1 in which the auger is rotated by a plurality of hydraulic motors.

9. In apparatus for strip mining an area including a layer of valuable material covered by a layer of overburden presenting a ground surface;

a. a vehicle including traction elements movable over said ground surface, b. a guide connected to said vehicle and positioned closely adjacent to said ground surface, c. an auger assembly movable vertically within said guide including an auger casing, an auger rotatable in said casing and held against longitudinal movement relative to the casing, and a square cutter at the lower end of said auger casing, d. power means for moving said auger assembly vertically relative to said guide, e. power means for rotating said auger relative to said auger casing, f. a first discharge port at the upper end of said auger casing through which spoil from said overburden is removed from said auger, g. a conveyer having one end at said first discharge port for receiving spoil therefrom, h. a second discharge port at the upper end of said auger casing through which valuable material is removed from said auger, i. a conveyer having one end at said second discharge port receiving valuable material from said second discharge port, j. a movable closure associated with each of said discharge ports, and k. a movable rake associated with each discharge port and movable into an effective position in the upper convolution of said auger when the discharge port with which it is associated is open and into a retracted ineffective position when the discharge port with which it is associated is closed.

10. The apparatus of claim 9 in which each of said moveable closures takes the form of a sliding door, together with a cylinder piston assembly mounted on the upper end of said auger assembly for moving each of said sliding doors.

11. The apparatus of claim 9 in which each of said rakes is pivotally mounted on a vertical axis together with means for swinging each rake in the form of a hydraulic motor for each rake mounted on the auger assembly at the upper end thereof.

12. In strip mining of a layer of valuable material covered by a layer of overburden, a method comprising the steps of:

a. successively forming a plurality of shafts of substantially square horizontal cross section with each shaft merging in with adjacent shafts whereby a designated area is completely mined, b. each of said shafts being formed by a vertically movable auger assembly including an auger casing, an auger rotatable in and held against longitudinal movement relative to the auger casing, and a square cutter at the lower end of said auger casing, c. removing overburden spoil from the upper end of the auger as the auger cuts through the overburden, d. conveying said spoil to a previously formed shaft, e. removing valuable material from the upper end of the auger as the auger cuts through the layer of valuable material, and f. conveying said valuable material to a storage receptacle.

13. In apparatus for strip mining an area including a layer of valuable material covered by a layer of overburden presenting a ground surface;

a. a vehicle including traction elements movable over said ground surface, b. a guide connected to said vehicle and positioned closely adjacent to said ground surface, c. an auger assembly movable vertically within said guide including an auger casing, an auger rotatable in said casing and held against longitudinal movement relative to the casing, and a square cutter at the lower end of said auger casing, d. power means for moving said auger assembly vertically relative to said guide, e. power means for rotating said auger relative to said auger casing, f. a first discharge port at the upper end of said auger casing through which spoil from said overburden is removed from said auger, g. a conveyer having one end at said first discharge port for receiving spoil therefrom, h. a second discharge port at the upper end of said auger casing through which valuable material is removed from said auger, i. a conveyer having one end at said second discharge port receiving valuable material from said second discharge port, j. a movable closure associated with each of said discharge ports, k. a vertical rack on each wall of said vertical casing, and l. four hydraulic motors mounted on said guide with each of said hydraulic motors including a pinion engaging one of said gears, with said four hydraulic motors constituting said power means.

* * * * *